US011754099B2

(12) United States Patent
Zenner et al.

(10) Patent No.: US 11,754,099 B2
(45) Date of Patent: Sep. 12, 2023

(54) METHOD FOR REPAIRING A PISTON-CYLINDER UNIT WITHIN A WORKING MACHINE

(71) Applicant: LIEBHERR-COMPONENTS KIRCHDORF GMBH, Kirchdorf (DE)

(72) Inventors: Christian Zenner, Illertissen (DE); Jennifer Kries, Memmingen (DE)

(73) Assignee: LIEBHERR-COMPONENTS KIRCHDORF GMBH, Kirchdorf (DE)

( * ) Notice: Subject to any disclaimer, the term of this patent is extended or adjusted under 35 U.S.C. 154(b) by 0 days.

(21) Appl. No.: 18/046,090

(22) Filed: Oct. 12, 2022

(65) Prior Publication Data

US 2023/0122544 A1 Apr. 20, 2023

Related U.S. Application Data

(62) Division of application No. 16/560,946, filed on Sep. 4, 2019, now Pat. No. 11,499,573.

(30) Foreign Application Priority Data

Sep. 4, 2018 (DE) ..... 10 2018 121 549.5

(51) Int. Cl.
*F15B 15/14* (2006.01)

(52) U.S. Cl.
CPC ..... *F15B 15/1452* (2013.01); *F15B 15/1428* (2013.01); *F15B 15/1457* (2013.01)

(58) Field of Classification Search
CPC ..... F15B 21/003; F15B 15/1438; F15B 15/1447; F15B 15/1452; F15B 15/1428; F15B 15/1457; F15B 2215/30
See application file for complete search history.

(56) References Cited

U.S. PATENT DOCUMENTS

| | | | |
|---|---|---|---|
| 6,761,104 | B2 | 7/2004 | Hoogen |
| 8,122,812 | B2 | 2/2012 | Herwig |

FOREIGN PATENT DOCUMENTS

| | | | |
|---|---|---|---|
| CN | 203321934 | U | 12/2013 |
| CN | 207673645 | U | 7/2018 |
| DE | 29908563 | U1 | 10/1999 |
| DE | 10156504 | C1 | 4/2003 |
| DE | 102007037760 | A1 | 2/2009 |
| DE | 102010011239 | A1 | 9/2011 |
| EP | 2025951 | A2 | 2/2009 |

*Primary Examiner* — Moshe Wilensky
(74) *Attorney, Agent, or Firm* — McCoy Russell LLP

(57) ABSTRACT

Disclosed is a method for repairing a piston-cylinder unit within a working machine or within an attachment, wherein a connection of the piston rod with the machine or implement structure is released and the piston rod, the piston and at least one bearing head is jointly removed from the cylinder housing as an assembly and replaced by a pre-mounted substitute assembly consisting of piston rod, piston and at least one bearing head.

3 Claims, 1 Drawing Sheet

METHOD FOR REPAIRING A PISTON-CYLINDER UNIT WITHIN A WORKING MACHINE

CROSS-REFERENCE TO RELATED APPLICATION

The present application is a divisional of U.S. Non-Provisional patent application Ser. No. 16/560,946, entitled "METHOD FOR REPAIRING A PISTON-CYLINDER UNIT WITHIN A WORKING MACHINE," and filed on Sep. 4, 2019. U.S. Non-Provisional patent application Ser. No. 16/560,946 claims priority to German Application No. DE 10 2018 121 549.5 filed on Sep. 4, 2018. The entire contents of each of the above-listed applications are hereby incorporated by reference for all purposes.

TECHNICAL FIELD

The disclosure relates to a repair method for a piston-cylinder unit mounted within a working machine.

BACKGROUND

Piston-cylinder units for a working machine must withstand extreme conditions during on-site operation. By way of example, reference is made to a grab cylinder of a working machine for material handling. For the above reasons, such working cylinders must be robust and be designed especially for the case of application in order to be able to guarantee a particularly long service life of the component. In the course of the operating times, however, signs of wear appear, in particular in the installed seals of the piston or of the rod. Moreover, material damage at the piston rod cannot be excluded.

In the case of a defect of the working cylinder or leakage because of a damaged piston rod, the entire working cylinder is removed from the working machine or the working implement and sent to a specialist workshop. There, the cylinder is disassembled more or less completely in order to exchange the defective components. The repaired cylinder is then sent back to the machine operator. For example in cylinders for earth-moving machines, the complete disassembly of the cylinder and the exchange of defective components takes about two to four hours. Additionally, time is also needed for the removal of the cylinder from the working machine and the transport to and from the specialist workshop. Further, various special tools are necessary for disassembling the cylinder, which are mostly available only to specialist workshops or at least are not available at the site of the working machine.

SUMMARY

It is the objective of the present application to make such a repair method not only less time-consuming, but also more economical for manufacturers and machine operators.

This object is solved by a method for repairing a piston-cylinder unit within a working machine or within an attachment, wherein a connection of the piston rod with the machine or implement structure is released and the piston rod, the piston, and at least one bearing head are jointly removed from the cylinder housing as an assembly and replaced by a premounted substitute assembly consisting of piston rod, piston, and at least one bearing head.

According to the disclosure, it is proposed to repair the piston-cylinder unit directly in the working machine. The working machine preferably can be a construction machine, in particular a lifting device or an earth-moving machine. However, the method is also advantageous for working machines in the field of material handling. Furthermore, it is insignificant for the execution of the method whether the piston-cylinder unit is a pneumatic or hydraulic working cylinder.

The central idea essential for the invention consists in that the piston-cylinder unit largely remains mounted in the working machine or the attachment and instead only one assembly consisting of piston rod, piston and at least one bearing head is detached from the cylinder housing and the working machine or the attachment as a complete unit. Subsequently, the removed assembly is replaced by an appropriate substitute assembly. For this method step it is merely necessary to detach the piston rod from the machine or implement structure. For example, the lug of the piston rod is detached from the machine structure or a component of the attachment. When repairing a support cylinder, a support plate for example is demounted from the piston rod.

After separating the connection between the bearing head and cylinder housing, the assembly can be removed completely from the cylinder housing and replaced by a substitute assembly. When installing the substitute assembly it also applies that merely the connection between bearing head and cylinder housing must be established and the piston rod/lug must be connected with the machine or implement structure.

Summarized briefly, the complete removal of the piston-cylinder unit from the working machine or the attachment is omitted in the procedure according to the disclosure. A time-consuming shipment is not necessary either, and the substitute assembly can be delivered in advance. Further, the exchange of the assembly is finished in few working steps and the enormous time expenditure for the complete disassembly of the piston-cylinder unit can be drastically reduced.

Another advantage is that a repair need not necessarily be carried out by the manufacturer or a specialist workshop. The comparatively uncomplicated exchange of the assembly theoretically can be performed by the machine operator himself at the site of use of the machine. Ideally no special tool is necessary anymore for the repair. Due to the simplification of the method, the risk of a damage of cylinder components when carrying out the repair improperly is also reduced.

In principle, the method can be used for any kind of working machine. The repair method is also suitable for the cylinder units of an attachment for a working machine. For the sake of simplicity, reference chiefly is made below to a working machine, but the explanations given below equally apply to a piston-cylinder unit of an attachment.

As already indicated above, the cylinder or the cylinder housing can remain mounted on the machine or implement structure during the repair. However, this does not preclude that the cylinder housing alternatively can also be detached from the machine or implement structure or the piston-cylinder unit could be completely removed from the machine or the implement for the sake of simplicity.

According to an advantageous embodiment, the substitute assembly consists of a piston rod with fitted bearing head and premounted piston. Accordingly, the bearing head is disposed between the lug of the piston rod and the mounted piston.

For demounting the assembly, a corresponding fastening of the bearing head to the cylinder opening merely is to be released. In general, this is an appropriate screw connection of the bearing head with the cylinder housing. The same of course also applies for the mounting of the substitute assembly. Here as well, the corresponding fastening, i.e. the screw connection of the bearing head with the cylinder housing, merely must be restored.

According to another advantageous embodiment of the invention it is also provided that the piston and/or the bearing head are already equipped with an appropriate set of sealings. Alternatively, it is likewise conceivable to separately deliver the set of sealings of the piston with the substitute assembly, wherein the corresponding seals then must first be applied before inserting the assembly into the cylinder. Expediently, the seals of the bearing head should already be mounted in advance, i.e. the substitute assembly at least should be delivered with a set of sealings of the bearing head mounted already.

The method can be used in particular in construction machines or working machines for material handling and for their attachments. The repair method according to the invention is particularly advantageous for a grab cylinder of an attachment configured as a grab.

Beside the method of the invention, the present invention likewise relates to an installation kit for the repair of a piston-cylinder unit comprising a premounted substitute assembly for use during the repair method according to the invention. Such a premounted substitute assembly consists of a piston rod with at least one fitted bearing head and a mounted piston. It is likewise imaginable that a bearing head and/or piston already are equipped with a corresponding set of sealings.

BRIEF DESCRIPTION OF THE FIGURES

Further advantages and properties of the invention will be explained below with reference to an exemplary embodiment shown in the Figures, in which.

DETAILED DESCRIPTION

Figure 1:
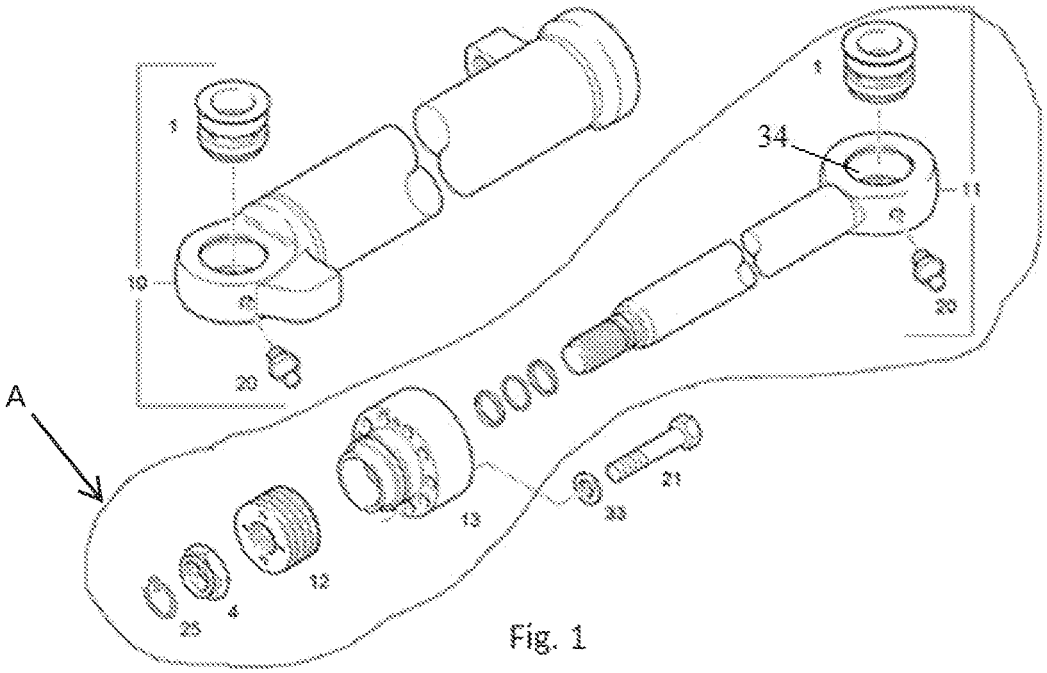
FIG. 1: shows a first exemplary embodiment of the installation kit according to the disclosure for a piston-cylinder unit within a working machine.

Beside the cylinder housing 10, FIG. 1 shows the installation kit according to the invention in an exploded representation. The installation kit comprises the corresponding assembly consisting of a piston rod 11, the fitted bearing head 13 and the premounted piston 12. At its end, the piston rod 11 comprises the corresponding lug 34 for mounting on the machine structure of a working machine. For this purpose, a corresponding steel bush 1 is inserted into the lug, the radial bore serves to accommodate a lubricating nipple, in particular a conical lubricating nipple 20, which serves for the sufficient lubrication of the lug. The lubricating nipple can also be contained in the installation kit.

At its end, the piston rod 11 comprises a thread on which the appropriate piston 12 can be placed. At its end, the piston 12 is fixed on the piston rod 11 with a nut 4 and the locking ring 25. The piston 12 carries sealing rings which are delivered already mounted together with the installation kit. The bearing head 13 can be screwed to the opening edge of the cylinder housing 10 by means of the hexagon screws 21. The bearing head also has already been provided with the corresponding sealing package at the factory. The hexagon screws 21 can also be contained in the installation kit. Instead of the aforementioned screw connection of the bearing head 13 with hexagon screws, the bearing head 13 can also be provided with an external thread. Such a bearing head not shown here can be screwed into the cylinder 10 via an appropriate counter-thread in the region of the cylinder opening.

According to the method of the invention, the entire assembly A is sold as a spare part and can easily be inserted on the spot as a complete unit into a cylinder 10 to be repaired. For this purpose, the defective assembly is removed from the cylinder 10 by releasing the bolt connection of the lug with the machine structure and by unscrewing the hexagon screws 21 of the bearing head. The entire assembly can then be pulled out of the cylinder 10. The installation of the substitute assembly is effected in reverse order, i.e. the assembly is pushed into the cylinder 10 with the premounted piston 12 first, and the bearing head 13 is moved to the corresponding position of the cylinder opening until the screws 21 can be screwed in. Finally, the lug of the piston rod 11 is connected to the machine structure. Experience has shown that the entire repair operation can be carried out within about 15 minutes.

Figure 2:
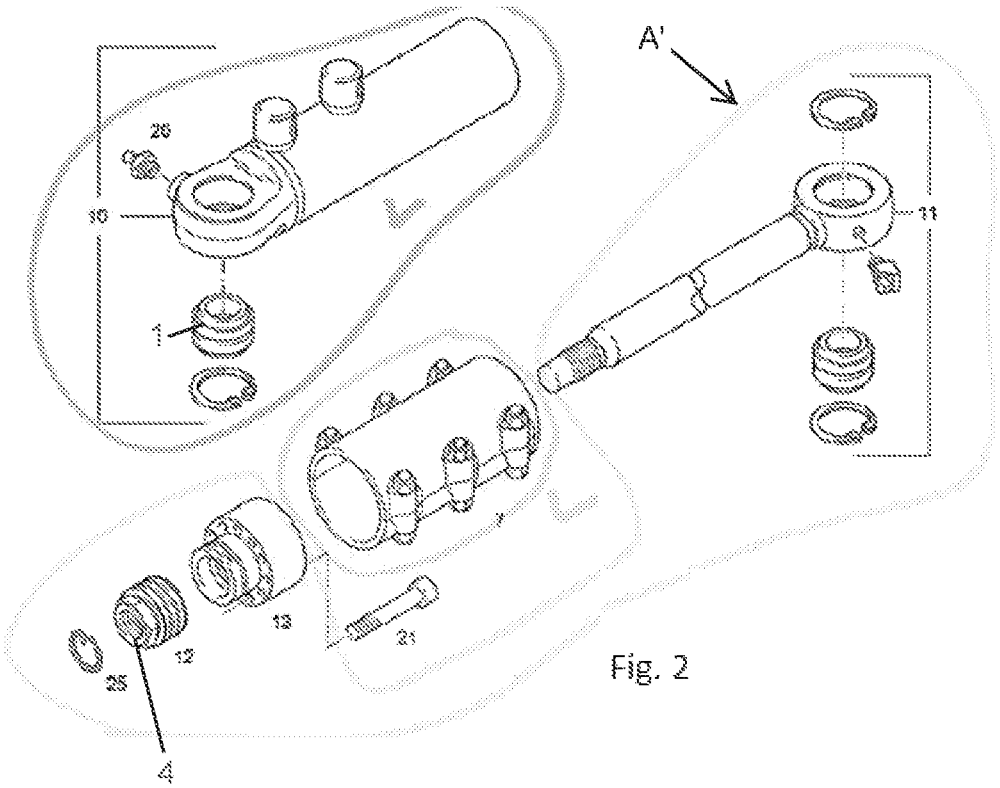
FIG. 2: shows an alternative embodiment of the installation kit according to the disclosure.

A slightly alternative configuration of the installation kit is shown in FIG. 2, wherein it also applies for this installation kit that the entire assembly A' is delivered premounted and is incorporated into the cylinder 10 as a whole.

By offering the completely premounted piston rod assembly with fitted bearing head and mounted piston as an assembly several advantages are obtained:

The time factor:

By means of the installation kit the time for disassembly and assembly can be reduced distinctly (to about 15 min). It is merely necessary to release the bearing head at the piston-cylinder unit to be repaired; subsequently, the complete package can be removed from the cylinder tube and the new package can be inserted. No special tools are required and the cylinder repair can also be effected on the spot at the construction site.

The cost factor:

In the event of damage, a substitute is available by means of the installation kit as quickly as in the presence of a new hydraulic cylinder. Such a kit, however, is a much more economical solution than a completely new hydraulic cylinder.

The quality factor:

Due to the premounted piston rod assembly no special tools are required anymore, which often are missing in the individual repair facilities. As the mounting of the assembly is effected in the factory of the manufacturer, the risk of errors or damages during disassembly and assembly can thus be minimized, and it is ensured in addition that exclusively original spare parts are used.

The method according to the invention is expedient in particular where smaller hydraulic cylinders are used in the field of working machines, for example in attachments or smaller earth-moving machines in excavators, wheel loaders or bulldozers. However, there is no reason why the idea underlying the invention should not also be selectively used for larger hydraulic cylinders.

The invention claimed is:

1. An installation kit comprising a pre-mounted substitute assembly comprising a piston rod with a bearing head fitted onto the piston rod and a pre-mounted piston for repair of a working machine or an attachment;

wherein the pre-mounted substitute assembly consists essentially of the piston, the bearing head, and the piston rod, the kit configured such that a cylinder of a piston-cylinder unit remains mounted on the working machine during the repair.

2. The kit of claim 1, wherein a screw connection connects the bearing head with a housing of the cylinder.

3. The kit of claim 2, wherein the piston and/or the bearing head of the substitute assembly include a set of sealings.

* * * * *